US005249681A

United States Patent [19]

Miller

[11] Patent Number: 5,249,681

[45] Date of Patent: Oct. 5, 1993

[54] CARTON DISPENSER SYSTEM

[75] Inventor: Charles A. Miller, Williamsburg, Ohio

[73] Assignee: The C. W. Zumbiel Co., Cincinnati, Ohio

[21] Appl. No.: 820,100

[22] Filed: Jan. 13, 1992

[51] Int. Cl.[5] ..... B65D 75/58

[52] U.S. Cl. ..... 206/427; 229/242; 229/122.1

[58] Field of Search ..... 229/240, 242, 122, 122.1; 206/427; 221/305

[56] References Cited

U.S. PATENT DOCUMENTS

| | | | |
|---|---|---|---|
| 2,385,400 | 9/1945 | Briggs | 229/122.1 |
| 2,751,075 | 6/1956 | Arneson | 206/154 |
| 2,754,047 | 7/1956 | Schmidt et al. . | |
| 3,071,306 | 1/1963 | Trethewey | 229/122 |
| 3,265,283 | 8/1966 | Farquhar . | |
| 3,300,115 | 1/1967 | Schaver | 229/242 |
| 3,356,279 | 12/1967 | Root . | |
| 3,517,858 | 6/1970 | Farquhar . | |
| 3,519,194 | 7/1970 | Kohlhaas et al. | 229/122 |
| 3,721,382 | 3/1973 | Cavanagh et al. . | |
| 3,807,624 | 4/1974 | Funkhouser . | |
| 3,894,681 | 7/1975 | Arneson et al. | 229/240 |
| 4,030,661 | 6/1977 | Farquhar . | |
| 4,058,354 | 11/1977 | Powaska | 312/42 |
| 4,155,449 | 6/1979 | Bryne . | |
| 4,214,660 | 7/1980 | Hunt, Jr. . | |
| 4,216,861 | 8/1980 | Oliff . | |
| 4,318,474 | 3/1982 | Hasegawa . | |
| 4,364,509 | 12/1982 | Holley, Jr. et al. . | |
| 4,378,877 | 4/1983 | Botterman et al. | 229/242 |
| 4,396,143 | 8/1983 | Killy . | |
| 4,398,636 | 8/1983 | Baxter | 229/242 |
| 4,497,433 | 2/1985 | Wischusen, III | 229/242 |
| 4,605,128 | 8/1986 | Rieke | 229/242 |

*Primary Examiner*—Stephen P. Garbe
*Assistant Examiner*—Christopher McDonald
*Attorney, Agent, or Firm*—Wood, Herron & Evans

[57] ABSTRACT

A dispenser system for containers, e.g., soft drink cans, held in matrix configuration within a carton. An outlet port is defined in each of the carton's first and second side walls with both the outlet ports being oriented on a single longitudinal axis oriented normal to the first and second side walls. The outlet ports are sized to allow egress of each container in the container series out of either one of the first and second side walls. This allows a container whose longitudinal axis is oriented co-axially with the longitudinal axis of the outlet ports to be pushed out of the carton through the outlet port in the first side wall by pushing on the container through the outlet port in the second side wall, and alternately through the outlet port in the second side wall by pushing on the container through the outlet port in the first side wall, all as desired by the carton user.

24 Claims, 2 Drawing Sheets

CARTON DISPENSER SYSTEM

This invention relates to cartons. More particularly, this invention relates to a dispenser system for a container carton.

Beverage packages or cartons particularly adapted for use with containers, e.g., cans, are very well known to the prior art in the marketing of beer or soft drink or the like. The typical beverage carton packages a series of beverage cans in a matrix configuration, and is fabricated from paperboard. Often such cartons are sized to hold eight or twelve or even twenty-four beverage cans for purchase by the retail consumer at, e.g., grocery stores or specialty markets. Such paperboard beverage can cartons or packages have seen widespread commercial success in the marketplace.

The prior art beverage cartons often incorporate a dispenser system feature that allows the retail consumer to remove the beverage cans, one by one, from the carton. A number of different structural embodiments are known for this dispenser system feature. The basic dispenser system is defined by one or more of the carton's paperboard walls, and includes a flap tear out structure of some kind or another which opens the carton only partially so that one or more, but not all, the cans may be removed in sequence as desired by the end user. One specific type of prior art carton dispenser system, and one that has seen widespread commercial use in the marketplace, is that which allows the beverage cans to be drawn out one at a time from a bottom forward corner of the can carton when it is stored on edge in, e.g., a refrigerator. This prior art dispenser system involves a tear out mouth in the front bottom corner of the can carton which extends across the width of the carton's forward end wall, and which allows the beverage can to be gripped by a user's fingers at the ends thereof so that it can be drawn out of the carton's mouth. A subsidiary feature to this basic dispenser system is that the mouth may be provided with a retainer flap which partially covers the mouth. The retainer flap attempts to act as a brake so that only one can at a time is removed, the retainer flap attempting to prevent those cans that remain in the carton from rolling out of the carton in response to the push out forces exerted by the weight of the cans remaining in the carton. Typical of this basic kind of transverse mouth tear out dispenser system for a beverage can carton are those can carton structures shown in U.S. Pat. Nos. 4,396,143; 4,364,509; and 3,894,681.

Now there are several disadvantages with the prior art dispenser system discussed above, and illustrated in the above-noted patents, from the retail consumer standpoint. First, and as noted, when the first can of a carton is removed from the carton's transverse mouth there is a substantial weight which bears on the next can that rolls forward for removal. And sometimes, even with a retainer flap defined by the carton whose function is to brake or prevent the next can from rolling out, other cans will roll out on their own after a first can has been removed. When subsequent cans roll out on their own against the user's desire, same may fall to the floor which could cause a safety problem. But in any event, whatever cans undesirably roll out must be returned to the carton or to the storage location, e.g., the refrigerator, with the accompanying frustration or displeasure that such an event causes. Second, once the carton dispenser system is opened with a beverage carton dispenser system of the transverse mouth type as described above, i.e., once the transverse mouth is created by tearing out the appropriate flap structure from the carton's bottom corner, then the closure integrity of the carton is immediately destroyed. In other words, and once the carton's transverse mouth has been opened, from a realistic standpoint it is no longer possible to carry the carton with full cans therein by whatever handle structure is provided on the carton. This for the simple reason that in carrying the open mouth carton there is little question but what the full beverage cans remaining therein will roll out the open mouth against the user's desire. And thirdly, with a prior art beverage carton having the transverse end mouth dispenser system as described above, the carton can be oriented only on its bottom wall in order to withdraw full cans through the carton's discharge mouth. Such prior art cartons often are of rectangular configuration, and it may be desirable to stand the carton on its end wall (which is normally of lesser length than its bottom wall) in order to save space in the environment, e.g., a refrigerator, within which the carton is stored. But this is not possible with the prior art cartons because the opened transverse mouth would not be readily accessible to the carton's user, and cans could not be readily withdrawn therefrom if the prior art carton was stood on that end wall within which the transverse mouth was defined.

Accordingly, it has been one objective of this invention to provide a carton dispenser system particularly adapted for use with, e.g., beverage cans such as beer cans or soft drink cans, that allows individual cans within the carton's can matrix stored to be withdrawn from that carton one at a time through either one of the two side walls of the carton through an outlet port located in each of those side walls, thereby maintaining the structural integrity of the carton even with the carton's two side wall outlet ports open by not destroying any portion of the end walls or top or bottom walls of the carton.

In accord with this objective, this invention is directed to a carton adapted to hold a series of containers, e.g., beverage cans, the longitudinal axis of each can being oriented parallel to the longitudinal axis of every other can in a can matrix. The carton includes opposed parallel first and second side walls, the can axes being oriented normal to those side walls in the final package. An outlet port is defined in each of the carton's first and second side walls, both the outlet ports being oriented on a single longitudinal axis also oriented normal to the carton's first and second side walls. Each of the outlet ports is sized to allow egress of each can in the can matrix out of either one of the carton's first and second side walls. This allows a can whose longitudinal axis is oriented co-axially with the longitudinal axis of the outlet ports to be pushed out of the carton through the outlet port in the first side wall by pushing on the can through the outlet port in the second side wall, and alternatively through the outlet port in the second side wall by pushing on the can through the outlet port in the first side wall, when selected and as desired by the carton's user. Preferably, each of the outlet ports is located at a corner of the carton. Also preferably, a port flap removably closes each of the outlet ports, both the outlet port flaps being at least partially defined by cut lines formed in their associated side walls, and being removable by a user when removal of the cans from the carton is desired.

A carton with dispenser system in accord with this invention provides several distinct and advantageous features relative to the prior art. First, and when a carton filled with beverage cans is first opened in the user's storage location, neither the first can nor any successive can in the carton can inadvertently roll or fall out of the carton as long as it is stored on its bottom wall. Second, and importantly, when the carton is carried by a handle structure defined in the carton's top wall, again no can in the carton will fall or roll out of the carton as long as the carton's side walls are maintained generally perpendicular relative to ground. And third, the carton may be stored either in, e.g., a refrigerator, by standing it on its end wall or by standing it on its bottom wall in order to maximize space efficiency in the storage environment as desired by the user, and whether stored on either an end wall or the bottom wall the cans in the carton can be easily removed therefrom.

Other objectives and advantages of this invention will be more apparent from the following detailed description taken in connection with the drawings in which.

Figure 3:
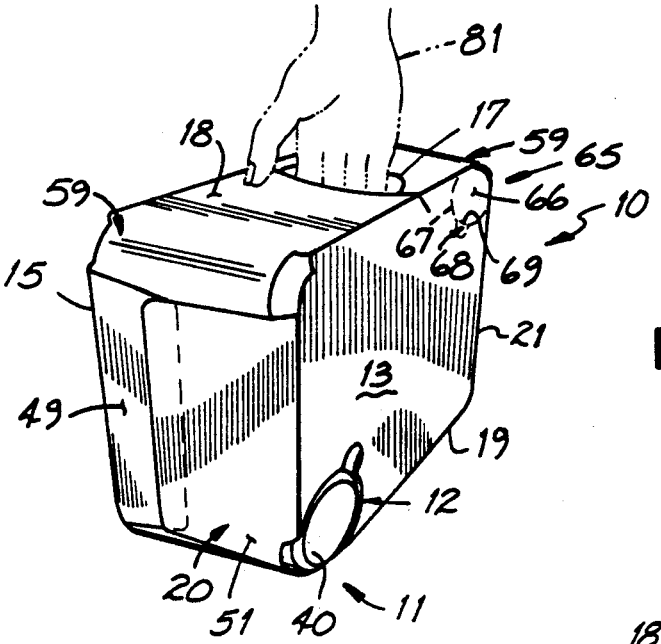
FIG. 3 is a perspective view of the carton illustrated in FIG. 1, the opened carton being shown in a carrying attitude.
Figure 1:
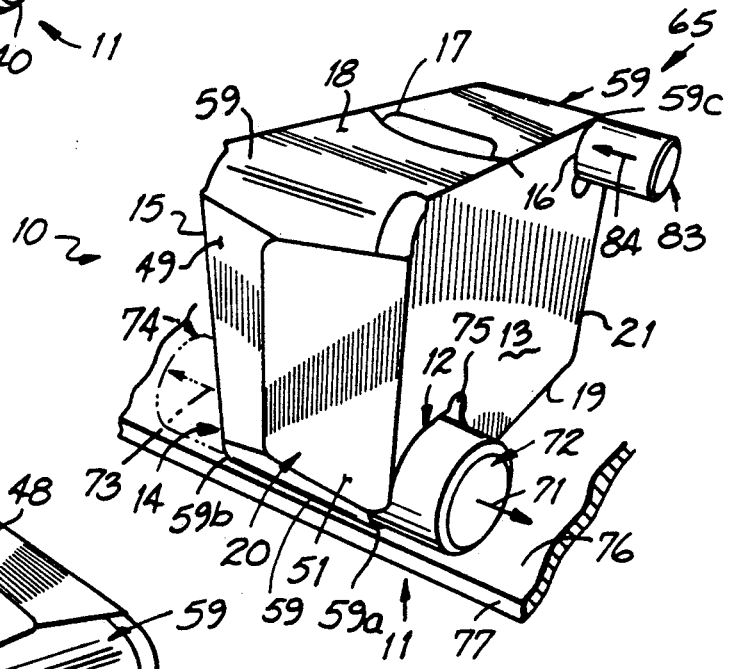
FIG. 1 is a perspective view of a carton with a dispenser system in accord with the principles of this invention, the opened carton being stored on its bottom wall on a suitable support surface.
Figure 2:
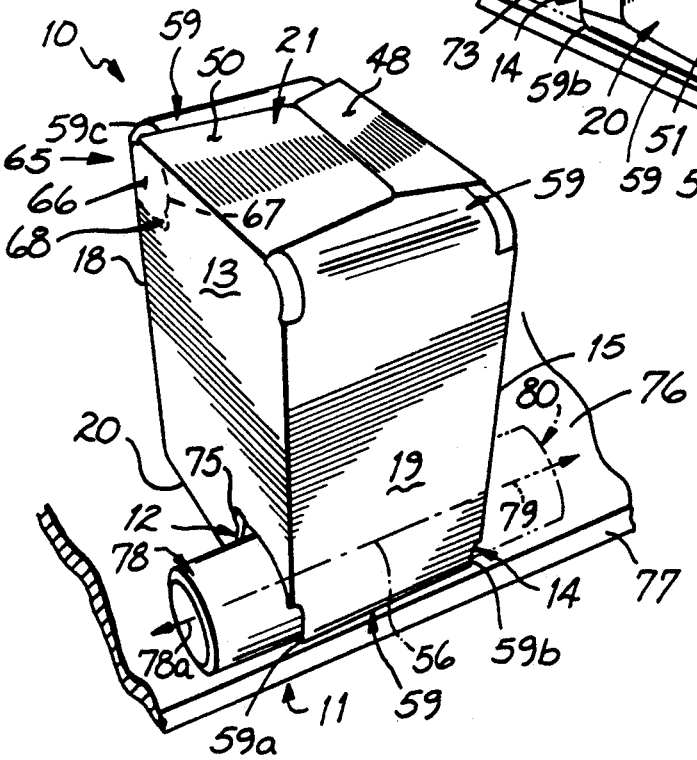
FIG. 2 is a perspective view of the carton illustrated in FIG. 1, same being stored on its forward end wall on a suitable support surface.
Figure 4:
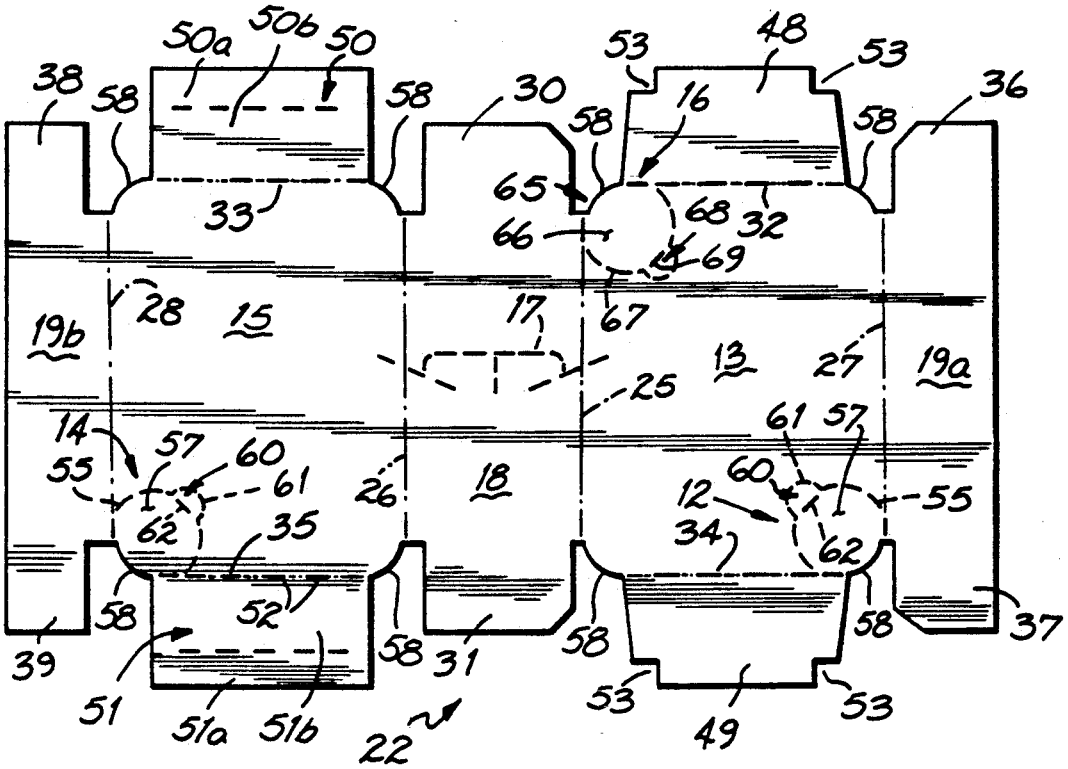
FIG. 4 is a top plan view of a carton blank in accord with the principles of this invention.

A sleeve style closed end carton 10 with carton dispenser system 11, all in accord with the principles of this invention, is illustrated in FIGS. 1–3. The carton 10 itself includes an outlet port 12 on the carton's first side wall 13, an outlet port 14 on the carton's second side wall 15, an inlet port 16 on the carton's first side wall 13, a handle structure 17 in the carton's top wall 18, a floor 19, a front end wall 20, and a rear end wall 21. This carton 10 is fabricated from a carton blank 22 in accord with the principles of this invention as illustrated in FIG. 4. The structural details of the carton blank 22 utilized with the carton dispenser system 11 of this invention, as well as the structural details of the carton 10 itself, are more disclosed in greater detail in pending U.S. patent application Ser. No. 754,649, also assigned to the assignee of this invention, the detailed description of same also being incorporated herein by reference.

The carton blank 22, more particularly, is comprised of a first side wall 13 panel having a full top wall 18 panel connected on fold line 25 to one side edge thereof. A second side wall 15 panel is connected on fold line 26 to the other edge of the full top wall panel 18. A first partial bottom wall panel **19*a* is connected on fold line 27 to the first side wall 13 panel, and a second partial bottom wall panel 19*b* is connected along fold line 28 to the second side wall 15 panel. The full top wall panel 18 includes a handle structure 17 which itself forms no part of this invention. A detailed disclosure of that handle structure 17** is to be found in U.S. Pat. No. 4,784,316, assigned to the assignee of this invention, the detailed description of same being incorporated herein by reference.

Corner flaps 30, 31 are provided integral with each end of the full top wall panel 18, those corner flaps extending outwardly beyond the end edges 32, 33 and 34, 35 of the first 13 and second 15 side wall panels, respectively. Also, corner flaps 36, 37 and 38, 39 are provided integral with each partial bottom wall panel **19*a*, 19*b* respectively, those corner flaps 36–39 also extending outwardly beyond the end edges 32, 33 and 34, 35 of the first and second side wall panels, respectively. Note particularly these corner flaps 30, 31, 36–39 are simply integral with the top 18 and bottom 19*a*, 19*b* wall panels, respectively, in that they are not separated from those top and bottom wall panels by any score line or slit line. Accordingly, the corner flaps 30, 31, 36–39 can be and are wrapped around corner cans 41–44 of a can matrix 40 in the final assembled carton 10 package so as to fit snugly against those corner cans, and thereby hold all those corner cans as well as all other cans 45** in a tight matrix configuration in the package.

The carton blank 22 also includes end flap panels 48, 49 that extend outwardly from the scored end edges 32, 34, respectively, of the first side wall 13 panel, and end flap panels 50, 51 that extend outwardly from the scored end edges 33, 35, respectively, of the second side wall 15 panel. These end score lines 32–35 preferably are enhanced for folding by the inclusion of spaced slits 52. Each second side wall end flap panel 50, 51 is subdivided into an outer fold up glue panel **50*a*, 51*a* at its outer edge, and an inner locator panel 50*b*, 51*b*. The fold up glue panels 50*a*, 51*a* and in gluing of the carton 10 together in closed package form. Each first side wall end flap panel 48, 49 is provided with notched out corners 53 at its opposed outer corners to allow the second side wall end flap panels 50, 51 to be glued to the corner flaps 30, 31, 36–39, as well as to the first side wall end flap panels 48, 49. Note particularly the first side wall end flap panels 48, 49 are tapered from the fold lines 32, 34 connection with the second side wall 13 to the outer edge thereof, same being to ensure that first side wall end flap panels are oriented or located within the side edges of the second side wall end flap panels 50, 51 when the carton 10** package is glued together in final assembly form.

Now importantly relative to this invention, and as particularly illustrated in FIG. 4, the carton blank 22 includes two outlet ports 12, 14, one defined in each of the first 13 and second 15 side walls. These outlet ports 12, 14 are defined in the side walls 13, 15 by perforated cut lines 55 in those side walls. Each of the outlet ports 12, 14 is located in its associated side wall 13, 15 so that the two outlet ports are oriented on a single longitudinal axis 56 oriented normal to the first 13 and second 15 side walls when the carton 10 is erected as shown in FIGS. 1–3. And each of the outlet ports 12, 14 is sized to allow egress of each can 41–45 in the can matrix out of either one of the first 13 and second 15 side walls. In other words, the diameter D of each outlet port 12, 14 is at least equal to, but preferably slightly greater than, the diameter D' of the cans 41–45 in the carton's can matrix.

Each of the outlet ports 12, 14 includes a port flap 57 that removably closes the outlet port 12, 14, the port flap 57 constituting part and parcel of its associated side wall 13 or 15 in the carton blank 22 as formed as shown in FIG. 4. The port flap 57 is also partially defined by the rounded corner 58 of the carton's side wall corner 59 in which it is located. A finger tab 60 is connected with each port flap 57, the finger tab extending outwardly beyond the periphery of the port flap. The finger tab 60 also is defined by perforated cut lines 61 formed in its associated side wall 13 or 15, is connected with the port flap by fold line 62, and also constitutes part and parcel of its associated side wall 13 or 15 in the carton blank 22 as formed as shown in FIG. 4. The perforated cut lines 55, 61, therefor, allow the finger tab 60 and the port flap 57 to be removed from the side wall 13 or 15 when desired by the end user described in greater detail below.

The inlet port 16 is defined in at least one of the first 13 and second 15 side walls. The inlet port 16 is sized to allow ingress of a can 41–45 back into the carton 10 that was previously pushed out of the carton. The inlet port 16 is located at a corner 65 in its side wall 13 that is diagonally opposite to the outlet port 12 in that same side wall. As with the outlet ports 12, 14, the inlet port 16 includes a port flap 66 defined by perforated cut lines 67 in the side wall 13 adjacent the corner 65. The diameter D″ of the inlet port 16 is at least as great as the diameter D′ of the cans 41–45 within the can matrix. Further, the inlet port flap 66 includes a finger tab 68 connected thereto. As with the outlet ports' finger tabs 60, the inlet port's finger tab 68 extends beyond the periphery of the inlet port 16, and is connected by fold line 69 to the inlet port flap 66. Thus, the inlet port flap 66 can be removed from its associated side wall 13 in the same way as the outlet port flaps 57 are removed from their associated side walls 13, 15.

Figure 5:
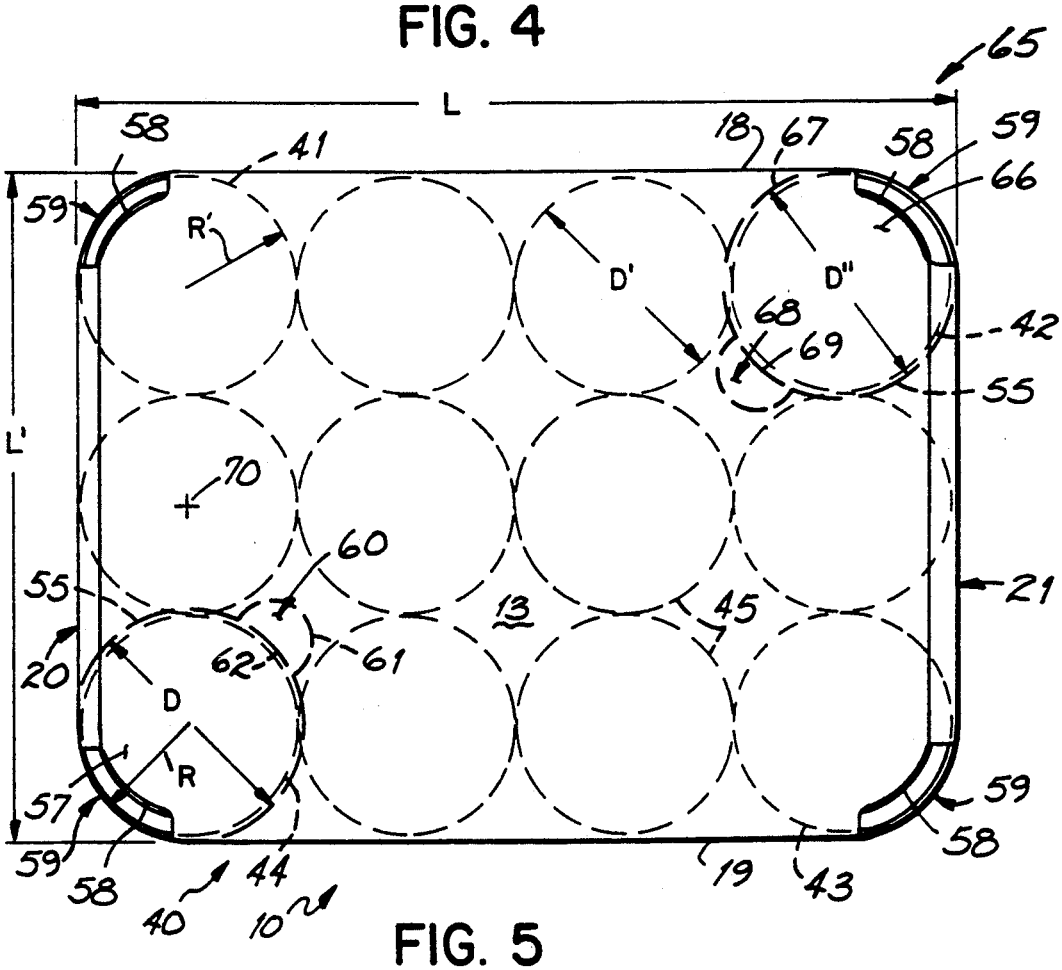
FIG. 5 is a side elevation view of a carton in accord with the principles of this invention.

In use, and as illustrated in FIGS. 1–3 and 5, the carton blank 22 is erected into a carton 10 adapted to hold a series of cans 41–45 in a matrix configuration. As shown in FIG. 5, the longitudinal axis 70 of each can 41–45 within the carton 10 is oriented parallel to the longitudinal axis of every other can in that can matrix. And as illustrated in FIGS. 1–3, the carton blank 22 is erected into a carton 10 with opposed parallel first 13 and second 15 side walls, the can axes 70 of the cans 41–45 in the can matrix being oriented normal to those first and second side walls. The carton 10, with the can matrix suitably enclosed therein, is distributed from soft drink bottlers through retail outlets to retail consumers with all of the outlet 12, 14 and inlet 16 ports closed, i.e., with the outlet 57 and inlet 66 port flaps integral with and not removed from their respective side walls 13, 15, and with the handle structure 17 not broken away from the carton's top wall 18. After purchase at a retail outlet, and in order to take the filled beverage package or carton 10 home, the retail consumer can break away the carton's handle structure 18 so that the carton 10 can be carried by that handle structure. But the outlet port flaps 57 and inlet port flap 66 are not removed from the carton 10 until use of the beverage cans 41–45 stored within the carton is desired by the retail customer.

When use of the beverage cans 41–45 is desired, and as shown in FIG. 1, the carton 10 may be stored on a shelf 76 in, e.g., a refrigerator. In order to remove the cans 41–45 one by one from the carton 10, both of the carton's outlet port flaps 57 are removed or torn away from the carton's two side walls 13, 15 so as to open both the carton's outlet ports 12, 14. With the carton 10 stored on its bottom wall 19 as shown in FIG. 1, because both outlet ports 12, 14 are oriented on a single longitudinal axis 56 that is oriented normal to the first 13 and second 15 side walls, and because each of the outlet ports 12, 14 is sized to allow egress of each can 41–45 in the can matrix out of either one of the first and second side walls, the consumer can simply withdraw the can that is rolled to the front corner 59 of the carton 10 either through first side wall 13 in that direction illustrated by arrow 71 and the solid lines can 72 in FIG. 1, or in the opposite direction through second side wall 15 in that direction illustrated by phantom arrow 73 phantom lines can 74 in FIG. 1. In other words, a can 41–45 whose longitudinal axis 70 is oriented co-axially with the longitudinal axis 56 of the outlet ports 12, 14 can be pushed out of the carton 10 through outlet port 12 in the first side wall 13 by pushing on the container through outlet port 14 in the second side wall 15, and alternatively can be pushed out of the carton through the outlet port 14 in the second side wall 15 by pushing on the can through the outlet port 12 in the first side wall 13, all as desired and as selected by the carton's user. Further, the finger opening 75 defined in each side wall 13, 15 adjacent that side wall's associated outlet port 12, 14 allows a consumer's finger to extend slightly into the carton 10 so as to aid in pulling the can out of the carton if that withdrawal method is desired. This carton dispenser system 11 allows either side wall 13 or 15 of the carton 10 to be placed flush up against the side wall (not shown) of a storage area, e.g., a refrigerator, while the carton's bottom wall 19 rests on the storage area's shelf 76, while still allowing cans to be withdrawn from that one of the carton's side walls which remains accessible.

The carton 10 is stored on a shelf 76 while resting on its bottom wall 19 as shown in FIG. 1, and cans 41'45 can be easily removed from the carton while it is stored in that posture because the carton's outlet ports 12, 14 are located at the shelf's front edge 77. On the other hand, and as illustrated in FIG. 2, the carton 10 also can be stored on its front end wall 20 with the cans 41–45 being easily removed from the carton while the carton is so stored because in this front end wall storage position the carton's outlet ports 12, 14 also are located at the shelf's front edge 77. As shown in FIG. 2, with the carton 10 stored on its front end wall 20, with the carton's outlet ports 14 adjacent the storage shelf's front edge 77, and as described above in connection with the FIG. use orientation, the cans 41–45 within the carton can be withdrawn from the outlet port 12 in the first side wall 13 (as shown by the solid line can 78 and the arrow **78*a*), or the outlet port 14 in the second side wall 15 (as shown by the phantom arrow 79 and the phantom can 80). Now in the carton 10 as erected, the two end walls 20, 21, the top wall 18 and the bottom wall 19 all cooperate with one another to provide arcuate corners 59 for the carton, each of the arcuate corners having a radius R about equal to the radius R′ of the corner cans 41–44 within the carton. And the outlet ports 12, 14 are located in the carton's side walls 13, 15 at arcuate side wall corners 59*a*, 59*b* of the carton. Accordingly, the periphery of each of the outlet ports 12, 14 is partially defined by a side wall 13 or 15 and also partially defined by the associated arcuate corner 59. In the carton 10 embodiment shown, the carton's bottom wall 19 is of greater length L than the length L′ of the carton's front wall 20 because of the three can by four can matrix configuration as shown in FIG. 5. And so it may be desirable from a storage space efficiency standpoint to store the carton 10 on its end wall 20 as illustrated in FIG. 2 instead of on its bottom 19 as illustrated in FIG. 1. The advantage of this carton dispenser system 11, therefor, is that cans 41–45 can be withdrawn from the carton 10 whether the carton is stored on either its bottom wall 19 or on its front end wall 20 since the outlet ports 12, 14 are located in the side wall corners of the front end wall and the bottom wall. And this provides additional flexibility of use to the retail consumer in storage of the carton 10 while maintaining the ability to withdraw cans 41–45** from the carton.

Note particularly as illustrated in FIG. 3, that with the outlet ports 12, 14 open the carton 10 can be easily carried (as indicated by the phantom hand 81) without the cans remaining in the carton falling out of the carton as long as the carton's side walls 13, 15 are maintained generally perpendicular relative to ground. In other words, the structural integrity of the carton 10 is maintained at all of its four corners 59, and particularly at that corner 59*a*, 59*b* from which the individual cans are withdrawn as desired, because of the structural integrity of the arcuate corner 59 defined between the carton's front end wall 20 and the carton's floor 19 even when the outlet ports 12, 14 are open.

The inlet port 16 is defined in the first side wall 13 at that corner 59*c* diagonally opposite the corner 59*a* with the outlet port 12 in that first side wall when inlet port flap 66 is removed. The inlet port 16 allows access to the carton's interior for receiving empty cans (note solid line can 83 and arrow 84 in FIG. 1) that have been used after being withdrawn from the carton. In other words, the inlet port 16 is sized to allow ingress of a can back into the carton that had been previously pushed out of the carton. Of course, the inlet port flap 66 may or may not be removed when the outlet ports' flaps 57 are removed, all as desired by the end user.

Having described in detail the preferred embodiment of my invention, what I desire to claim and protect by Letters Patent is:

I claim:

1. 1. A package comprising a series of containers, each container of said series being of the same size and shape as every other container of said series, the longitudinal axis of each container being oriented generally parallel to the longitudinal axis of every other container in said series, and a carton within which said series of containers is positioned, said carton comprising opposed generally parallel first and second side walls, the container axes of said container series being oriented generally normal to said first and second side walls, and an outlet port defined in each of said first and second side walls, both said outlet ports being oriented on a single longitudinal axis oriented generally normal to said first and second side walls, and each of said outlet ports being sized to allow egress of each container in said container series out of either one of said first and second side walls, thereby allowing each container whose longitudinal axis is oriented co-axially with the longitudinal axis of both said outlet ports to be pushed out of said carton through said outlet port in said first side wall by pushing on said container through said outlet port in said second side wall, and alternatively allowing each container to be pushed out of said carton through said outlet port in said second side wall by pushing on said container through said outlet port in said first side wall, as desired by the carton user.

2. A package as claimed in claim 1, each outlet port being located at a corner of its associated side wall.

3. A package as claimed in claim 2, each of said side walls being generally rectangular in configuration, and each of said series having a generally circular cross section, said carton comprising two end walls, a top wall and a bottom wall, all walls together forming a closed carton, at least one of said end walls and said bottom wall defining an arcuate corner having a radius about equal to the radius of each container of said series, and said outlet ports being located in said side walls at said arcuate corner of said carton.

4. A package as claimed in claim 3, the periphery of each of said outlet ports being partially defined by a side wall and also partially defined by said arcuate corner.

5. A package as claimed in claim 1, said carton comprising an outlet port flap removably closing each of said outlet ports, both said outlet port flaps being removable by a user when removal of said containers from within said carton is desired.

6. A package as claimed in claim 5, each of said outlet port flaps being formed from its associated side wall, and each of said outlet port flaps being at least partially defined by cut lines formed in its associated side wall.

7. A package as claimed in claim 6, said carton comprising a finger tab connected to each port flap.

8. A package as claimed in claim 7, each of said finger tabs being formed from its associated side wall, each of said finger tabs being defined by cut lines formed in its associated side wall.

9. A package as claimed in claim 8, each outlet port being located at a corner of its associated side wall.

10. A package as claimed in claim 1, said carton comprising an inlet port defined in one of said first and second side walls, said inlet port being sized to allow ingress of a container previously pushed out of said carton back into said carton.

11. A package as claimed in claim 10, each outlet port being located at a corner of its associated side wall, and said inlet port being located at a corner of its side wall that is diagonally opposite that outlet port in that same side wall.

12. A package as claimed in claim 11, said carton comprising a port flap removably closing each of said outlet ports and said inlet port, both said outlet port flaps and said inlet port flap being removable by a user when removal of said containers from said carton is desired and when replacement of said containers inside said carton is desired.

13. A package comprising a series of containers in a matrix configuration, each container of aid series being of the same size and shape as every other container of said series, the longitudinal axis of each container being oriented generally parallel to the longitudinal axis of every other container in said series, and a carton blank foldable about said container series to form a carton, said carton blank comprising opposed first and second side walls, said side walls being oriented generally parallel one to the other when said carton is erected about said carton matrix, the container axes of said container series being oriented generally normal to said first and second side walls when said carton is erected and when said series is within said erected carton, an outlet port defined in each of said first and second side walls, both said outlet ports being oriented on a single longitudinal axis oriented generally normal to said first and second side walls when said carton is erected, and each of said outlet ports being sized to allow egress of each container in said container series out of either one of said first and second side walls when said series is within said carton, thereby, when said carton is erected, allowing each container whose longitudinal axis is oriented co-axially with the longitudinal axis of both said outlet ports to be pushed out of said carton through said outlet port in said first side wall by pushing on said container through said outlet port in said second side wall, and alternatively allowing each container to be pushed out of said carton through said outlet port in said second side wall by pushing on said container through said outlet port in said first side wall, when said series is within said carton and as desired by the carton user.

14. A package as claimed in claim 13, each outlet port being located at a corner of its associated side wall.

15. A package as claimed in claim 14, each of said side walls being generally rectangular in configuration, and each container of said series having a generally circular cross section, said blank comprising two end walls, a top wall and a bottom wall, all walls together forming a closing carton when said carton blank is erected, and also when said carton blank is erected at least one of said end walls and said bottom wall defining an arcuate corner having a radius about equal to the radius of each container of said series, and said outlet ports being located in said side walls at said arcuate corner of said carton.

16. A package as claimed in claim 15, the periphery of each of said outlet ports being partially defined by a side wall and also partially defined by said arcuate corner.

17. A package as claimed in claim 13, said carton blank comprising an outlet port flap removably closing each of said outlet ports, both said outlet port flaps being removable by a user after said carton is erected when removal of said containers from within said carton is desired.

18. A package as claimed in claim 17, each of said port flaps being formed from its associated side wall, each of said flaps being at least partially defined by cut lines formed in its associated side wall.

19. A package as claimed in claim 15, said carton blank comprising a finger tab connected to each port flap.

20. A package as claimed in claim 19, each of said finger tabs being formed from its associated side wall, each of said finger tabs being defined by cut lines formed in its associated side wall.

21. A package as claimed in claim 20, each outlet port being located at a corner of its associated side wall.

22. A package as claimed in claim 13, said carton blank comprising an inlet port defined in one of said first and second side walls, said inlet port being sized to allow ingress of a container previously pushed out of said carton back into said carton when said carton is erected from said blank.

23. A package as claimed in claim 22, each outlet port being located at a corner of its associated side wall, and said inlet port being located at a corner of its side wall that is diagonally opposite that outlet port in that same side wall.

24. A package as claimed in claim 23, said carton blank co a port flap removably closing each of said outlet ports and said inlet port, both said outlet port flaps and said inlet port flap being removable by a user when removal of said containers from a carton erected from said carton blank is desired, and when replacement of said containers inside said carton is desired.

* * * * *

UNITED STATES PATENT AND TRADEMARK OFFICE

CERTIFICATE OF CORRECTION

PATENT NO. : 5,249,681

DATED : October 5, 1993

INVENTOR(S) : Charles A. Miller

It is certified that error appears in the above-indentified patent and that said Letters Patent is hereby corrected as shown below:

In Col. 4, line 30, delete "and" and substitute --aid--.

In Col. 6, line 27, delete "41'45" and substitute --41-45--.

In Col. 6, line 40, please add --1-- after the word "Fig."

In Claim 3, Col. 8, line 1, after "each" please insert the word --container--.

In Claim 13, Col. 8, line 54, delete "aid" and substitute --said--.

In Claim 15, Col. 9, line 31 delete "closing" and substitute --closed--.

In Claim 24, Col. 10, line 34, delete "co" and substitute --comprising--.

Signed and Sealed this

Ninth Day of August, 1994

Bruce Lehman

*Attest:*

BRUCE LEHMAN

*Attesting Officer*

*Commissioner of Patents and Trademarks*